United States Patent [19]

Lubbers

[11] Patent Number: 4,742,752

[45] Date of Patent: May 10, 1988

[54] DRUM HEAD TENSIONING DEVICE

[76] Inventor: David Lubbers, 14 Clark Hill Rd., East Hampton, Conn. 06424

[21] Appl. No.: 33,997

[22] Filed: Apr. 2, 1987

[51] Int. Cl.[4] ..... G10D 13/02

[52] U.S. Cl. ..... 84/413; 84/419

[58] Field of Search ..... 84/411–421

[56] References Cited

U.S. PATENT DOCUMENTS

| | | | |
|---|---|---|---|
| 160,600 | 3/1875 | Kearsing | 84/205 |
| 283,352 | 8/1883 | McCord | 84/419 X |
| 387,023 | 7/1888 | Van Sandt | 84/411 R |

FOREIGN PATENT DOCUMENTS

| | | | |
|---|---|---|---|
| 543 | of 1886 | United Kingdom | 84/411 A |

*Primary Examiner*—Lawrence R. Franklin

*Attorney, Agent, or Firm*—McCormick, Paulding & Huber

[57] ABSTRACT

A drum head tensioning device includes an annular fitting supporting a screw for rotation on a radial axis of the drum. A cable is connected to the conventional tension hoop and to a nut threadably received on the screw. Rotating the screw tensions the cable and hence pulls down the hoop to tension the drum head.

25 Claims, 2 Drawing Sheets

DRUM HEAD TENSIONING DEVICE

This invention relates generally to percussion type musical instruments of the drum variety having a drum head stretched across at least one end of a walled sound chamber. More specifically, this invention deals with means for tensioning the drum head to vary its pitch.

In conventional drums the drum head is stretched over the rim of the cylindrical side wall defining the sound chamber of the drum and is tensioned by means of circumferentially spaced bolts extending parallel to the axis of the drum and acting on hoop means which encircles the rim and is attached to the periphery of the drum head. Tightening of the bolts pulls the hoop down around the rim and tensions the drum head. The greater the number of tensioning bolts the more evenly tension can be applied to the drum head.

One aim of the present invention is to provide a tensioning device without the cumbersome external mechanism normally required for drawing the hoop downwardly so as to achieve the desired tension in the drum head.

Another object of the invention is to provide a tensioning device that is easily adjusted by minimizing the internal friction of the moving parts.

In accordance with the present invention a plurality of fittings is provided in circumferentially spaced relationship around the axis of the head end of the walled chamber defining the shell of the drum. Each fitting is spaced below the hoop means that is conventionally provided around the head end of the drum, and a threaded screw is rotatably provided in each fitting so that the threaded screw is located entirely inside the walled sound chamber itself rather than externally on the drum.

A nut is threadably supported on each of these screw and cable means is coupled to each such nut and secured to the hoop means so that rotation of the screw causes tensioning of the cable and thereby draws the hoop downwardly to achieve the desired tension in the drum head.

The cable means comprises individual cable segments associated with each fitting, and each cable segment has its ends swaged and received in openings provided at circumferentially spaced locations in the hoop means. An intermediate portion of the cable segment passes around a midpoint of the nut and the nut also includes an opening for slidably receiving the nut on a fixed stud or post provided parallel to the screw inside the sound chamber. The fixed post so provided in the fitting serves to prevent rotation of the nut and also serves to secure the annular fitting in an opening provided for this purpose in the wall of the drum itself. Each fitting has two cable openings spaced on either side of the threaded screw, which screw is rotatably supported in the fitting on the radially extending central axis of the fitting itself.

As so constructed and arranged the cable segment has two portions or legs secured to the hoop at circumferentially spaced points and each leg angles downwardly toward the fitting where it turns approximately 90 degrees and runs generally parallel to the screw and post. The midportion of the cable segment is received by the nut.

DETAILED DESCRIPTION

Figure 2:
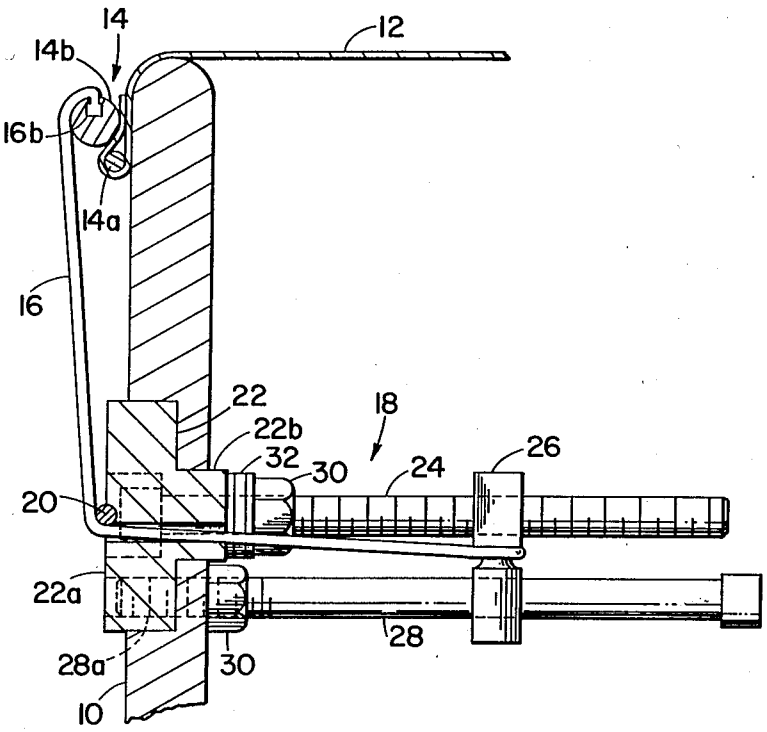
FIG. 2 is a sectional view taken generally on the line 2—2 of FIG. 1 and illustrates one such fitting in the drum of FIG. 1.

Turning now to the drawings in greater detail, a conventionally shaped drum shell 10 is provided with at least one end having a drum head 12 extending over the open end thereof. FIG. 2 shows in vertical section the shell side wall 10 of the generally cylindrical sound chamber together with the drum head 12 stretched across the open end thereof, and also shows hoop means 14 securing the periphery of the drum head to the cylindrical side wall 10. The hoop means may be of conventional configuration comprising two hoops, the smaller diameter flesh hoop being indicated generally at **14*a*. The tension hoop indicated generally at 14*b* is of such size and shape that the peripheral edge of the drum head 12 is trapped therebetween as shown in FIG. 2**. This configuration for the hoop means is conventional and is commonly used in drums generally.

In accordance with the present invention cable means in the form of a cable segment 16 is provided to connect the tension hoop **14*b* of the hoop means 14 to a tensioning device indicated generally at 18** and to be described in greater detail hereinbelow.

Figure 1:
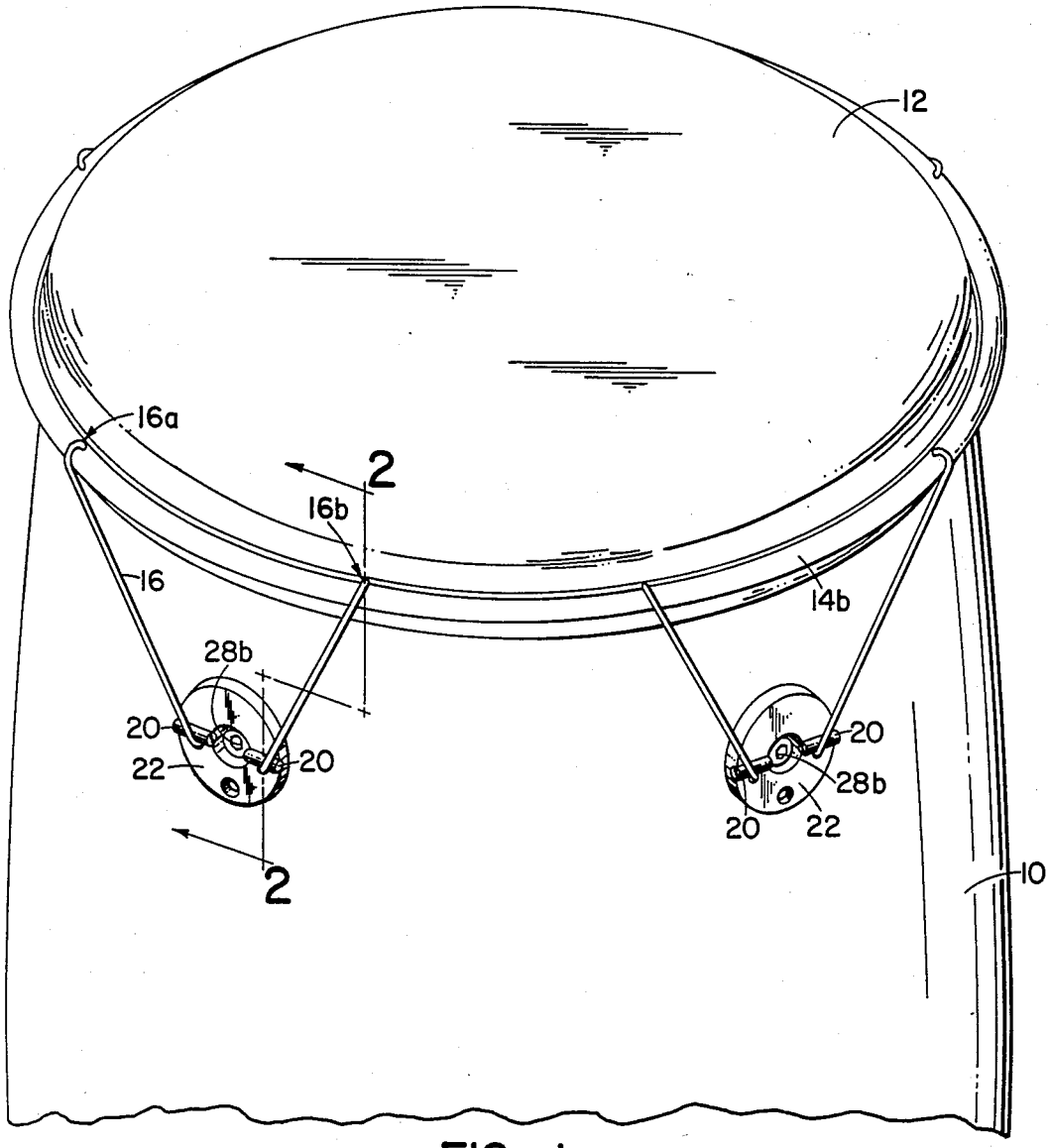
FIG. 1 is a perspective view of a drum equipped with tensioning devices constructed in accordance with the present invention.

As best shown in FIG. 1 the cable segment 16 has one swaged end secured in the tension hoop **14*b* while the opposite swaged end 16*b* of cable segment 16 is similarly secured in the same tension hoop 14*b*** at a point spaced circumferentially relative to the first mentioned attachment for the one swaged cable end.

As shown best in FIG. 2 the cable 16 has its swaged ends **16*a*, 16*b* secured in upwardly open recesses provided for this purpose in the tension hoop 14*b*. The cable 16 extends downwardly from these attachment points around cable guides indicated generally at 20 which cable guides are provided in an annular fitting 22** secured in the side wall of the drum shell.

The fitting 22 is of stepped annular configuration having an outer portion of somewhat larger diameter then the inner portion. The outer portion is indicated generally at **22*a* in FIG. 2 and the inner portion at 22*b*. A central opening in the annular fitting 22 rotatably receives a threaded screw 24, and a threaded nut 26 is received on this screw 24. The nut 26 is prevented from rotation relative to the rotatable screw 24 by a post 28, and the cable 16 encircles the nut 26. The cable has leg portions that are bent around cable guides 20 and end portions 16*a* and 16*b* of these cable leg portions are attached to the hoop 14*b* as suggested in FIG. 1**. The cable guides define a bend radius for the cable leg portions at least equal to the diameter of the cable itself.

The stud or guide shaft 28 for preventing rotation of nut 26 is arranged parallel to the screw 24 and is slidably received in an opening provided for this purpose in the nut 26. The guide shaft 28 is fixed relative to the fitting 20 and to the side wall 10 of the drum shell by means of a nut 30 secured to a threaded end portion **28*a* of the guide shaft 28 as shown. This end portion 28*a* of guide shaft 28 is also threadably received in an opening provided for this purpose in the outer annular portion 22***a* of the fitting 22. This serves to prevent rotation of the fitting 20 within its recess in the side wall 10 of the drum shell.

Figure 3:
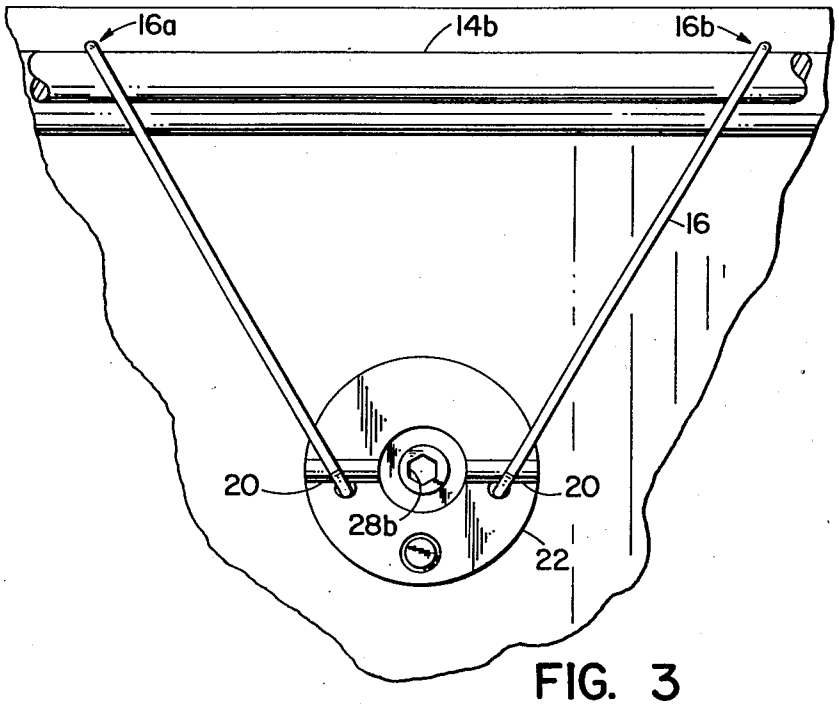
FIG. 3 is an elevational view illustrating the fitting and associated cable segment in elevational view.

The rotatable screw 24 also carries a nut 30 as shown in FIG. 2 which nut 30 serves to provide a reaction surface for a thrust bearing 32 provided between the nut 30 and the fitting 22 as shown. This thrust bearing is of conventional geometry consisting of inner and outer raceway washers together with a an intermediate retainer type washer for supporting a plurality of circumaxially spaced needle bearings. The outer or head end of screw 24 defines a tool receiving socket in the form of an allen wrench opening 28*b* as best shown in FIG. 1 and FIG. 3. As so constructed and arranged rotation of the screw 24 can be accomplished from outside the drum itself. Turning screw 24 serves to move nut 26 in a radial direction relative to the cylindrical side wall of the drum 10 tensioning the cable 16 and causing tension hoop 14*b* to be drawn downwardly and thereby tensioning the drum head 12. The drum head tensioning device disclosed herein provides most of the mechanism for tensioning the drum head within the confines of the sound chamber itself and avoids the necessity for providing a plurality of circumaxially spaced threaded bolts on the exterior of the drum. Furthermore, fewer tensioning devices are required since the cable 16 is arranged to form a generally equilateral triangle with the leg portions of the cable segment 16 being inclined outwardly from the fitting 22 for attachment to spaced apart points in the tension hoop 14*b*. FIG. 3 illustrates this geometry and FIG. 1 shows four such tensioning devices so arranged as to provide very close control of the tension hoop 14*b* as the musician adjusts the tension of his drum head and hence its musical pitch. The musician can even pluck at these cables to ascertain that the tension of each cable is substantially the same by simply listening to and comparing the sound made by each cable so plucked.

I claim:

1. In a percussion instrument of the type having a drum head stretched across one end of a walled sound chamber, and drum head tensioning means for varying the pitch of the instrument by axially adjusting the location of hoop means surrporting the drum head, the improvement to said tensioning means comprising:

a plurality of fittings arranged in spaced circumaxial relationship around the axis of the head end of said walled chamber, each fitting being spaced below said hoop means, each said fitting having a cable guide portion, a threaded screw rotatably provided in each said fitting and oriented radially relative to said axis, a nut threadably supported on each said threaded screw, and cable means coupled to each said nut and secured to said hoop meas so that rotation of said screw causes the tension to vary in said drum head by adjusting the axial position for the hoop means, said cable means having a portion passing through said cable guide poritons.

2. The combination of claim 1 wherein said cable means comprises individual cable segments having at least one swaged end received in an opening in said hoop means, and said cable segment having a portion provided in an opening in said fitting and another portion coupled to said nut.

3. The combination of claim 2 further characterized by a guide shaft supported by said fitting and arranged parallel to said screw, said nut having an opening for slidably receiving said guide shaft, and said nut having a portion intermediate said screw and guide shaft opening coupled to said cable segment.

4. The combination of claim 2 wherein each said cable segment has an end opposite said one end, said opposite cable end also swaged to fit into another correspondingly shaped opening in said hoop means, said hoop openings for said swaged cable ends being spaced from one another, and said cable segment having an intermediate portion coupled to said nut.

5. The combination of claim 4 further characterized by a guide shaft supported by said fitting and arranged parallel to said screw, said nut having an opening for slidably receiving said guide shaft, and said nut having a portion intermediate said screw and guide shaft opening coupled to said cable segment.

6. The combination of claim 5 wherein each said fitting has two cable openings, said cable intermediate portion passing through said openings and around said nut intermediate said nut threaded opening and said nut guide shaft opening.

7. The combination of claim 6 wherein each said fitting comprises a base received in an opening provided for it in said sound chamber wall and defining a central opening for rotatably supporting said threaded screw, said screw having a head end which is accessible from outside said walled sound chamber to allow for manual rotation of said screw outside said sound chamber.

8. The combination of claim 7 further characterized by a thrust bearing on said threaded screw, said thrust bearing provided between said screw and said base to react to the tension forces in said cable segment.

9. The combination of claim 8 wherein said openings for said cable segment are spaced radially from said central opening, and wherein said cable segment has portions outside and inside said walled sound chamber, said cable portions forming substantial bend angles, and cable guides at said bends to provide a radius of curvature for said cable that is at least equal to the diameter of the cable itself.

10. The combination of claim 9 wherein said fitting base is of annular configuration with an outer annular portion of larger diameter than an inner annular portion, and said opening for said fitting base being stepped to accommodate said annular inner and outer portions, said guide shaft provided in a bore of said outer annular portion of said base that is spaced from said screw opening, and said guide shaft extending through an opening in said sound chamber wall that is spaced from the inner annular base portion whereby rotation of said annular base in said sound chamber wall is prevented.

11. The combination of claim 10 wherein said guide shaft has a threaded end, said guide shaft opening being threaded to receive said guide shaft threaded end.

12. The combination of claim 11 further characterized by a lock nut for said guide shaft threaded end.

13. The combination of claim 8 wherein said screw includes a reaction surface for said thrust brearing.

14. The combination of claim 10 wherein said screw reaction surface is defined by a threaded nut secured on said threaded screw.

15. In a percussion instrument of the type having a drum head stretched across one end of a walled sound chamber, and having drum head tensioning means for varying the pitch of the instrument by axially adjusting the location of the hoop means supporting the drum head, the improvement to said tensioning means comprising:

a plurality of fittings arranged in spaced circumaxial relationship around the axis of the head end of said walled chamber, each fitting being spaced below said hoop means, a threaded screw rotatably provided in each said fitting, a guide shaft supported by said fitting and arranged parallel to said screw, a nut threadably supported on each said threaded screw, each said nut having an opening for slidably receiving said guide shaft, cable segments coupled to each said nut and having one end secured to said hoop means so that rotation of said screw causes the tension to vary in said drum head by adjusting the axial position for the hoop means, and each said nut having a portion intermediate said screw and guide shaft opening coupled to said cable segment.

16. The combination of claim 15 wherein each said cable segment has an end opposite said one end, said opposite cable end and said one end being swaged and fitting into correspondingly shaped openings in said hoop means, said hoop openings for said swaged cable ends being spaced from one another, and said cable segment having an intermediate portion coupled to said nut.

17. The combination of claim 16 wherein each said fitting has two cable openings, said cable intermediate portion passing through said openings and around said nut intermediate said nut threaded opening and said nut guide shaft opening.

18. The combination of claim 17 wherein each said fitting comprises a base received in an opening provided for it in said sound chamber wall and defining a central opening for rotatably supporting said threaded screw, said screw having a head end which is accessible from outside said walled sound chamber to allow for manual rotation of said screw outside said sound chamber.

19. The combination of claim 18 further characterized by a thrust bearing on said threaded screw, said thrust bearing provided between said screw and said base to react to the tension force in said cable segment.

20. The combination of claim 19 wherein said openings for said cable segment are spaced radially from said central opening, and wherein said cable segment has portions outside and inside said walled sound chamber, said cable portions forming substantial bend angles, said cable guide portions defining a radius of curvature for said cable that is at least equal to the diameter of the cable itself.

21. The combination of claim 20 wherein said fitting base is of annular configuration with an outer annular portion of larger diameter than an inner annular portion, and said opening for said fitting base being stepped to accommodate said annular inner and outer portions, said guide shaft provided in a bore of said outer annular poriton of said base that is spaced from said screw opening, and said guide shaft extending through an opening in said sound chamber wall that is spaced from the inner annular base portion whereby rotation of said annular base in said sound chamber wall is prevented.

22. The combination of claim 21 wherein said guide shaft has a threaded end, said guide shaft opening being threaded to receive said guide shaft threaded end.

23. The combination of claim 22 further characterized by a lock nut for said guide shaft threaded end.

24. The combination of claim 18 wherein said screw includes a reaction surface for said thrust brearing.

25. The combination of claim 24 wherein said screw reaction surface is defined by a threaded nut secured on said threaded screw.

* * * * *